US005816230A

United States Patent [19]

Kurokawa et al.

[11] Patent Number: 5,816,230

[45] Date of Patent: Oct. 6, 1998

[54] AIR-FUEL RATIO CONTROL SYSTEM FOR INTERNAL COMBUSTION ENGINES

[75] Inventors: Naohiro Kurokawa; Toru Kitamura; Norio Suzuki; Yuh Yoshii, all of Wako, Japan

[73] Assignee: Honda Giken Kogyo Kabushiki Kaisha, Tokyo, Japan

[21] Appl. No.: 901,721

[22] Filed: Jul. 28, 1997

[30] Foreign Application Priority Data

Aug. 8, 1996 [JP] Japan ..... 8-224610

[51] Int. Cl.[6] ..... F02D 41/00

[52] U.S. Cl. ..... 123/674

[58] Field of Search ..... 123/674, 673, 123/698, 676, 684, 691, 692; 364/431.05

[56] References Cited

U.S. PATENT DOCUMENTS

| | | | |
|---|---|---|---|
| 5,687,699 | 11/1997 | Shimada et al. | 123/673 |
| 5,694,910 | 12/1997 | Hasegawa | 123/674 |
| 5,694,911 | 12/1997 | Kawamoto et al. | 123/674 |
| 5,694,912 | 12/1997 | Gotou et al. | 123/674 |

FOREIGN PATENT DOCUMENTS 2-11842 1/1990 Japan .

8-28328 1/1996 Japan .

*Primary Examiner*—Raymond A. Nelli

*Attorney, Agent, or Firm*—Nikaido, Marmelstein, Murray & Oram LLP

[57] ABSTRACT

An air-fuel ratio control system for an internal combustion engine has a sensor which detects the air-fuel ratio of exhaust gases in an exhaust passage of the engine emitted from a plurality of cylinders. An air-fuel ratio of a mixture supplied to each of a plurality of cylinders is estimated, based on the detected air-fuel ratio and a model representative of a behavior of the exhaust passage. A cylinder-by-cylinder air-fuel ratio control amount is calculated for use in controlling the air-fuel ratio of the mixture supplied to the each of the cylinders in a feedback manner responsive to the estimated air-fuel ratio of the mixture such that the estimated air-fuel ratio of the mixture supplied to the each of the cylinders is converged to a desired air-fuel ratio. A learned value of the cylinder-by-cylinder air-fuel ratio control amount is calculated. When the difference between the detected air-fuel ratio and the estimated air-fuel ratio of the mixture supplied to the each of the cylinder is larger than a predetermined value, the calculation of the learned value of the cylinder-by-cylinder air-fuel ratio control amount is inhibited.

7 Claims, 12 Drawing Sheets

NE
PBA
θTH
PA
B1
TIMF
B2
B3
B4
B5
B6
B7
B8
B9
KTOTAL
KCMDM
TOUT
TOUT
TOUT
TOUT
1
ENG
KOBSV#1
B11
OBSV
PID
PID
PID
PID
B12
B14
B15
B13
KOBSV#3
KOBSV#4
KOBSV#2
KLAF
KCMD
B18
PID
B16
LPF
22
LPF
B10
SELV
17
LAF
19
CAT
18
O2
20
CAT
23
LPF
B21
KCMD
B22
MIDO2
FB
KCMD
B23
KCMDM

LAF F/B
STARTING MODE?
S1
YES
NO
CALCULATE KCMD,KCMDM
S2
SELECT LAF SENSOR OUTPUT
S3
CALCULATE KACT
S4
DETERMINE IF LAF SENSOR ACTIVE
S5
DETERMINATION OF LAF F/B CONTROL REGION
S6
FKLAFRESET =1 ?
S7
YES
NO
KLAF=1.0
KLAFI=0
S8
REFERENCE MODE?
S9
NO
YES
KOBSV#N=1.0
S11
KOBSV#N= KOBSV#Nstyi
S10
STARTING MODE CALCULATION
S14
CALCULATE KOBSV#N
S12
CALCULATE KLAF
S13
RETURN

AIR-FUEL RATIO CONTROL SYSTEM FOR INTERNAL COMBUSTION ENGINES

BACKGROUND OF THE INVENTION

1. Field of the Invention

This invention relates to an air-fuel ratio control system for internal combustion engines, and more particularly to an air-fuel ratio control system of this kind, which feedback-controls the air-fuel ratio of a mixture supplied to the engine separately for each cylinder, by the use of an observer based on a modern control theory.

2. Prior Art

Conventionally, there has been proposed, e.g. by Japanese Laid-Open Patent Publication (Kokai) No. 8-28328, an air-fuel ratio control system for internal combustion engines, which feedback-controls the air-fuel ratio of a mixture supplied to the engine separately for each cylinder (cylinder-by-cylinder air-fuel ratio feedback control) by estimating a cylinder-by-cylinder air-fuel ratio of the mixture supplied to the engine by the use of an observer introduced therefor, based on an output from an air-fuel ratio sensor arranged in a confluent portion of the exhaust system, which is proportional to the air-fuel ratio, and calculating an air-fuel ratio control amount based on the estimated cylinder-by-cylinder air-fuel ratio so as to minimize variations in air-fuel ratio between the cylinders, wherein a learned value of the air-fuel ratio control amount is calculated during execution of the feedback control, to be used when the air-fuel ratio sensor is inactive.

According to the proposed air-fuel ratio control system, however, the learned value of the air-fuel ratio control amount is calculated even immediately after the start of the cylinder-by-cylinder air-fuel ratio feedback control (e.g. immediately after the engine operating region has shifted from a high-load region suitable for open loop control to a feedback control region in which the cylinder-by-cylinder air-fuel ratio feedback control is carried out), or even during execution of a perturbation (forced fluctuation of a desired air-fuel ratio) for detecting deterioration of a catalytic converter arranged in the exhaust system of the engine, so that the calculated learned value can deviate from a proper value. Therefore, when the calculated learned value is used under an inactive condition of the air-fuel ratio sensor, the resulting actual air-fuel ratio can deviate from a desired value.

SUMMARY OF THE INVENTION

It is an object of the invention to provide an air-fuel control system for an internal combustion engine, which is capable of properly calculating a learned value of a cylinder-by-cylinder air-fuel ratio control amount, to thereby improve the air-fuel ratio controllability when the learned value is used.

To attain the above object, there is provided an air-fuel ratio control system for an internal combustion engine having a plurality of cylinders, and an exhaust system connected to the plurality of cylinders, comprising:

air-fuel ratio-detecting means arranged in the exhaust system;

cylinder-by-cylinder air-fuel ratio-estimating means for estimating an air-fuel ratio of a mixture supplied to each of the cylinders, based on an output from the air-fuel ratio-detecting means and a model representative of a behavior of the exhaust system;

cylinder-by-cylinder air-fuel ratio control amount-calculating means for calculating a cylinder-by-cylinder air-fuel ratio control amount for use in controlling the air-fuel ratio of the mixture supplied to the each of the cylinders in a feedback manner responsive to the estimated air-fuel ratio of the mixture such that the estimated air-fuel ratio of the mixture supplied to the each of the cylinders is converged to a desired air-fuel ratio;

learned value-calculating means for calculating a learned value of the cylinder-by-cylinder air-fuel ratio control amount; and inhibiting means for comparing a difference between the air-fuel ratio detected by the air-fuel ratio detecting means and the estimated air-fuel ratio of the mixture supplied to the each of the cylinders with a predetermined value, and when the former is larger than the latter, inhibiting the learned value-calculating means from calculating the learned value of the cylinder-by-cylinder air-fuel ratio control amount.

Preferably, the cylinder-by-cylinder air-fuel ratio-estimating means includes observer means for observing an internal operative state of the exhaust system by means of the model representative of the behavior of the exhaust system, and for estimating the air-fuel ratio of the mixture supplied to the each of the cylinders, based on the output from the air-fuel ratio-detecting means.

Preferably, the exhaust system has at least one confluent portion at which the air-fuel ratio-detecting means is arranged.

More preferably, the cylinder-by-cylinder air-fuel ratio-estimating means estimates the air-fuel ratio of the mixture supplied to the each of the cylinders, by the use of a time constant of response delay of the air-fuel ratio-detecting means.

More preferably, the inhibiting means inhibits the learned value-calculating means from calculating the learned value of the cylinder-by-cylinder air-fuel ratio control amount without comparing the difference between the air-fuel ratio detected by the air-fuel ratio detecting means and the estimated air-fuel ratio of the mixture supplied to the each of the cylinder with the predetermined value, before a predetermined time period elapses after start of the control of the air-fuel ratio of the mixture supplied to the each of the cylinders in the feedback manner responsive to the estimated air-fuel ratio of the mixture.

Further preferably, the engine has an intake system, the learned value-calculating means calculating the leaned value of the cylinder-by-cylinder air-fuel ratio control amount for each of a plurality of predetermined ranges of pressure within the intake system.

Still more preferably, when the air-fuel ratio-detecting means is inoperative and at the same time the engine is in a predetermined operating region determined by rotational speed of the engine and the pressure within the intake system, the learned value of the cylinder-by-cylinder air-fuel ratio control amount calculated for one of the plurality of predetermined ranges of pressure within the intake system is employed when the pressure within the intake system assumes a value within the one of the plurality of predetermined ranges.

The above and other objects, features, and advantages of the invention will become more apparent from the following detailed description taken in conjunction with the accompanying drawings.

DETAILED DESCRIPTION

The invention will now be described in detail with reference to the drawings showing an embodiment thereof.

Figure 1:
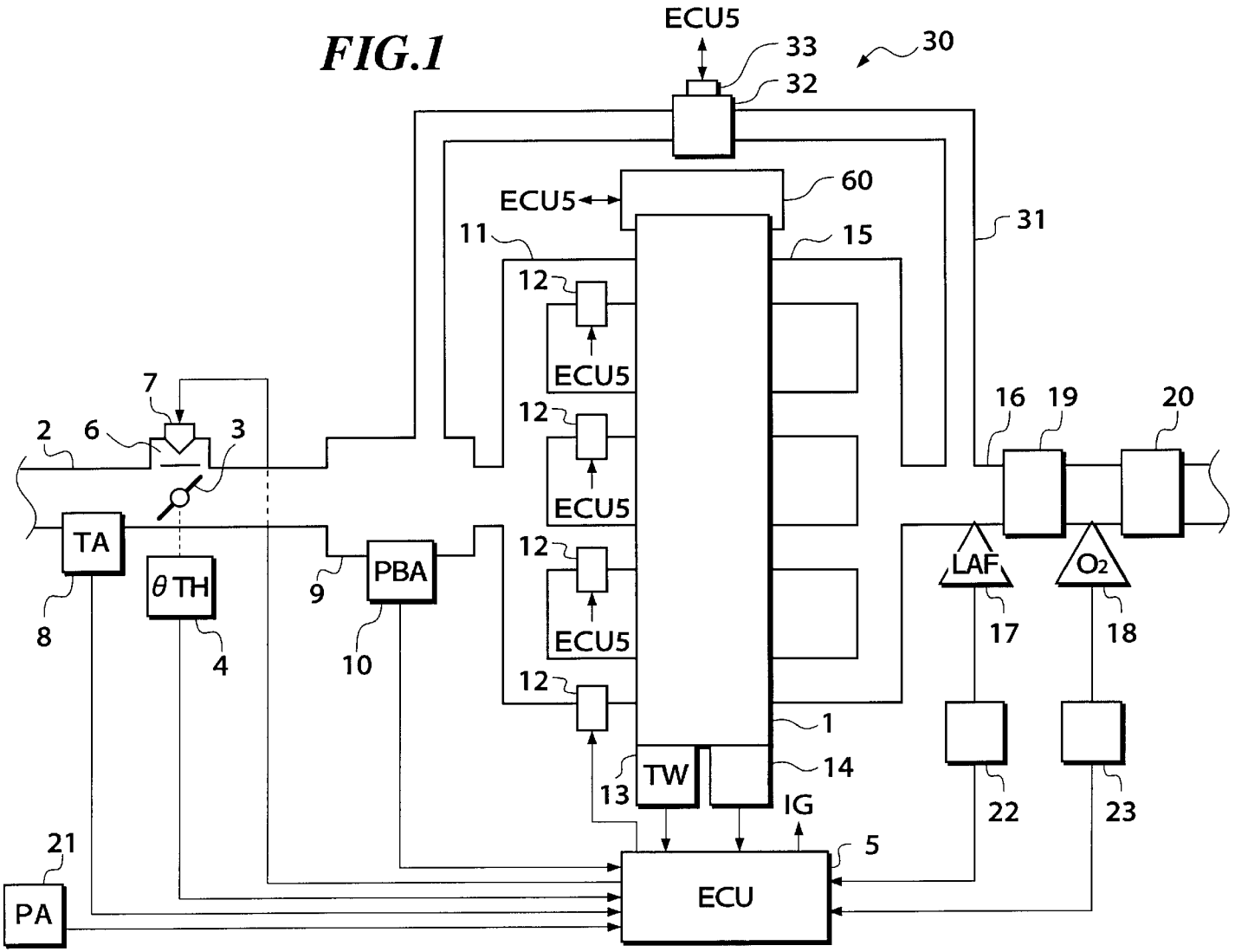
FIG. 1 is a block diagram showing the whole arrangement of an internal combustion engine incorporating an air-fuel ratio control system according to an embodiment of the invention.

Referring first to FIG. 1, there is shown the whole arrangement of an internal combustion engine (hereinafter simply referred to as "the engine") and an air-fuel ratio control system therefor, according to an embodiment of the invention. In the figure, reference numeral 1 designates a four-cylinder engine for automotive vehicles.

The engine 1 has an intake pipe 2 having a manifold part (intake manifold) 11 directly connected to the combustion chamber of each cylinder. A throttle valve 3 is arranged in the intake pipe 2 at a location upstream of the manifold part 11. A throttle valve opening (θ TH) sensor 4 is connected to the throttle valve 3 for generating an electric signal indicative of the sensed throttle valve opening θ TH and supplying the same to an electronic control unit (hereinafter referred to as "the ECU") 5. The intake pipe 2 is provided with an auxiliary air passage 6 bypassing the throttle valve 3, and an auxiliary air amount control valve (electromagnetic valve) 7 is arranged in the auxiliary passage 6. The auxiliary air amount control valve 7 is connected to the ECU 5 to have an amount of opening thereof controlled by a signal therefrom.

An intake air temperature (TA) sensor 8 is inserted into the intake pipe 2 at a location upstream of the throttle valve 3 for supplying an electric signal indicative of the sensed intake air temperature TA to the ECU 5. The intake pipe 2 has a thickened portion 9 as a chamber interposed between the throttle valve 3 and the intake manifold 11. An intake pipe absolute pressure (PBA) sensor 10 is arranged in the chamber 9 for supplying a signal indicative of the sensed intake pipe absolute pressure PBA to the ECU 5. An engine coolant temperature (TW) sensor 13, which may be formed of a thermistor or the like, is mounted in the cylinder block of the engine 1 filled with an engine coolant for supplying an electric signal indicative of the sensed engine coolant temperature TW to the ECU 5. A crank angle position sensor 14 for detecting the rotational angle of a crankshaft, not shown, of the engine 1 is connected to the ECU 5 for supplying signals corresponding to the rotational angle of the crankshaft to the ECU 5. The crank angle position sensor 14 is comprised of a cylinder-discriminating sensor which generates a pulse (hereinafter referred to as "the CYL signal pulse") at a predetermined crank angle position of a particular cylinder of the engine 1 assumed before a TDC position corresponding to the start of the intake stroke of the cylinder, a TDC sensor which generates a pulse (hereinafter referred to as "the TDC signal pulse") at a predetermined crank angle position of each cylinder assumed a predetermined angle before the TDC position (whenever the crankshaft rotates through 180 degrees in the case of a four-cylinder engine), and a CRK sensor which generates a pulse (hereinafter referred to as "the CRK signal pulse") at each of predetermined crank angle positions whenever the crankshaft rotates through a predetermined angle (e.g. 30 degrees) smaller than the rotational angle interval of generation of the TDC signal pulse. The CYL signal pulse, the TDC signal pulse and the CRK signal pulse are supplied to the ECU 5. These signal pulses are used for timing control in carrying out operations of the control system for determining fuel injection timing, ignition timing, etc., as well as for detecting the engine rotational speed NE.

Fuel injection valves 12 for respective cylinders are inserted into the intake manifold 11 at a location slightly upstream of intake valves, not shown, of the respective cylinders. The fuel injection valves 12 are connected to a fuel pump, not shown, and electrically connected to the ECU 5 to have their valve opening periods (fuel injection periods) and fuel injection timing controlled by signals therefrom. The engine 1 has spark plugs, not shown, provided for respective cylinders and electrically connected to the ECU 5 to have ignition timing θ IG thereof controlled by signals therefrom.

An exhaust pipe 16 of the engine has a manifold part (exhaust manifold) 15 directly connected to the combustion chambers of the cylinders of the engine 1. A linear output air-fuel ratio sensor (hereinafter referred to as "the LAF sensor") 17 is arranged in a confluent portion of the exhaust pipe 16 at a location immediately downstream of the exhaust manifold 15. Further, a first three-way catalyst (immediate downstream three-way catalyst) 19 and a second three-way catalyst (bed-downstream three-way catalyst) 20 are arranged in the confluent portion of the exhaust pipe 16 at locations downstream of the LAF sensor 17 for purifying noxious components such as HC, CO, and NOx. An oxygen concentration sensor (hereinafter referred to as "the O2 sensor") is arranged between the three-way catalysts 19 and 20.

As the linear output air-fuel ratio sensor 17 is used a LAF sensor as disclosed e.g. in Japanese Laid-Open Patent Publication (Kokai) No. 2-11842 filed by the present assignee. The LAF sensor 17 has a wide range output characteristic that its output changes linearly to the concentration of oxygen in exhaust gases.

The LAF sensor 17 is connected via a low-pass filter 22 to the ECU 5 for supplying the ECU 5 with an electric signal substantially proportional in value to the concentration of oxygen present in exhaust gases from the engine (i.e. the air-fuel ratio). The O2 sensor 18 has an output characteristic that output voltage thereof drastically changes when the air-fuel ratio of a mixture supplied to the engine changes across a stoichiometric air-fuel ratio to deliver a high level signal when the mixture is richer than the stoichiometric air-fuel ratio, and a low level signal when the mixture is leaner than the same. The O2 sensor 18 is connected via a low-pass filter 23 to the ECU 5 for supplying the ECU 5 with the high or low level signal.

The engine 1 is also provided with an exhaust gas recirculation system (EGR system) 30 which is comprised of an exhaust gas recirculation passage 31 connecting between the chamber 9 of the intake pipe 2 and the exhaust pipe 16, an exhaust gas recirculation (EGR) control valve 32 arranged in the exhaust gas recirculation passage 31 for controlling the amount of recirculated exhaust gases, and a lift sensor 33 for detecting opening of the EGR control valve 32 and supplying a signal indicative of the sensed opening of the EGR control valve 32 to the ECU 5. The EGR control valve 32 is formed by an electromagnetic valve having a solenoid which is connected to the ECU 5 to have its valve opening linearly changed by a control signal from the ECU 5.

The engine 1 has a valve timing changeover mechanism 60 which changes valve timing of at least the intake valves of the intake valves and exhaust valves between a high-speed valve timing suitable for operation of the engine in a high rotational speed region and a low-speed valve timing suitable for operation of the engine in a low rotational speed region. The changeover of the valve timing includes not only timing of opening and closing of the valve but also changeover of the valve lift amount, and further, when the low speed valve timing is selected, one of the two intake valves is rendered inoperative, thereby ensuring stable combustion within the combustion chamber even when the air-fuel ratio of the mixture is controlled to a leaner value than a stoichiometric air-fuel ratio.

The valve timing changeover mechanism 60 carries out changeover of the valve timing by means of changeover of hydraulic pressure for operating the valve, and includes an electromagnetic valve and an oil pressure sensor, neither of which is shown, which cooperate to effect the changeover of the hydraulic pressure. A signal from the oil pressure sensor is supplied to the ECU 5, and the ECU 5 controls the operation of the electromagnetic valve to effect changeover of the valve timing.

An atmospheric pressure (PA) sensor 21 is electrically connected to the ECU 5 for detecting atmospheric pressure PA, and supplying a signal indicative of the sensed atmospheric pressure PA to the ECU 5.

The ECU 5 is comprised of an output circuit having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU"), a memory device comprised of a ROM storing various operational programs which are executed by the CPU and various maps, referred to hereinafter, and a RAM for storing results of calculations from the CPU, etc., and an output circuit which outputs driving signals to the fuel injection valves 12 and other electromagnetic valves, the spark plugs, etc.

The ECU 5 operates in response to the above-mentioned signals from the sensors including the LAF sensor 17 and the O2 sensor 18 to determine various operating conditions in which the engine 1 is operating, such as an air-fuel ratio feedback control region in which the air-fuel ratio is controlled in response to outputs from the LAF sensor 17 and the O2 sensor 18, and open-loop control regions other than these regions, and calculates, based upon the determined operating conditions, the valve opening period or fuel injection period TOUT over which the fuel injection valves 12 are to be opened, by the use of the following equation (1) in synchronism with inputting of TDC signal pulses to the ECU 5, to deliver driving signals to the fuel injection valves 12, which are based on results of the calculation:

$$TOUT=TIMF\times KTOTAL\times KCMDM\times KLAF\times KOBSV\#N \quad (1)$$

Figure 2:
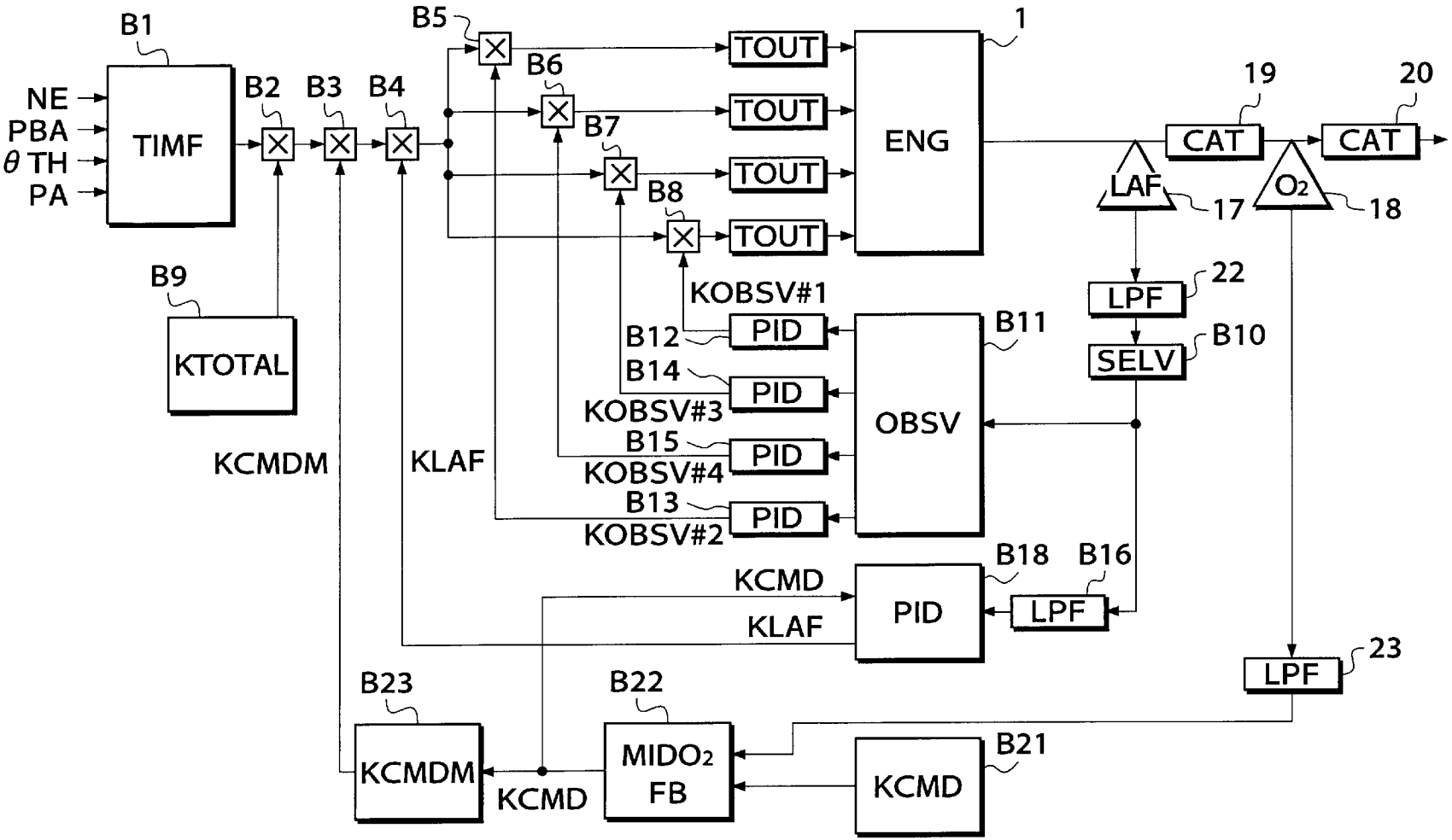
FIG. 2 is a block diagram useful in explaining the functions of the air-fuel ratio control system and a manner of controlling the air-fuel ratio of a mixture supplied to the engine.

FIG. 2 shows a block diagram which is useful in explaining a manner of calculation of the fuel injection period TOUT by the use of the equation (1). With reference to the figure, an outline of the manner of calculation of the fuel injection period TOUT according to the present embodiment will be described. It should be noted that in the present embodiment, the amount of fuel to be supplied to the engine is calculated, actually, in terms of a time period over which the fuel injection valve 6 is opened (fuel injection period), but in the present specification, the fuel injection period TOUT is referred to as the fuel injection amount or the fuel amount since the fuel injection period is equivalent to the amount of fuel injected or to be injected.

In FIG. 2, a block B1 calculates a basic fuel amount TIMF corresponding to an amount of intake air. The basic fuel amount TIMF is basically set according to the engine rotational speed NE and the intake pipe absolute pressure PBA. However, it is preferred that a model representative of a part of the intake system extending from the throttle valve 3 to the combustion chambers of the engine 1 is prepared in advance, and a correction is made to the basic fuel amount TIMF in dependence on a delay of the flow of intake air obtained based on the model. In this preferred method, the throttle valve opening θ TH and the atmospheric pressure PA are also used as additional parameters indicative of operating conditions of the engine.

Reference numerals B2 to B4 designate multiplying blocks, which each multiply the basic fuel amount TIMF by respective parameter values input thereto, and deliver the product values. These blocks carry out the arithmetic operation of the equation (1), and provide fuel injection amounts TOUT for the respective cylinders.

A block B9 multiplies together all feedforward correction coefficients, such as an engine coolant temperature-dependent correction coefficient KTW set according to the engine coolant temperature TW, an EGR-dependent correction coefficient KEGR set according to the amount of recirculation of exhaust gases during execution of the exhaust gas recirculation, and a purge-dependent correction coefficient KPUG set according to an amount of purged fuel during execution of purging of evaporative fuel by an evaporative emission control system, not shown, to obtain a correction coefficient KTOTAL, which is supplied to the block B2.

A block B21 determines a desired air-fuel ratio coefficient KCMD based on the engine rotational speed NE, the intake pipe absolute pressure PBA, etc. and supplies the same to a block B22. The desired air-fuel ratio coefficient KCMD is directly proportional to the reciprocal of the air-fuel ratio A/F, i.e., the fuel-air ratio F/A, and assumes a value of 1.0 when it is equivalent to the stoichiometric air-fuel ratio. For this reason, this coefficient KCMD will be also referred to as the desired equivalent ratio. The block B22 corrects the desired air-fuel ratio coefficient KCMD based on the output VMO2 from the O2 sensor 18 supplied via the low-pass filter 23, and delivers the corrected KCMD value to a block B18 and the block B23. The block B23 carries out fuel cooling-dependent correction of the corrected KCMD value to calculate a final desired air-fuel ratio coefficient KCMDM and supplies the same to the block B3.

A block B10 samples the output from the LAF sensor 17 supplied via the low-pass filter 22 with a sampling period in synchronism with generation of each CRK signal pulse, sequentially stores the sampled values into a ring buffer memory, not shown, and selects one of the stored values depending on operating conditions of the engine (LAF sensor output-selecting processing), which was sampled at the optimum timing for each cylinder, to supply the selected value to a block B11 and to the block B18 via a corresponding low-pass filter block B16. The LAF sensor output-selecting processing eliminates the inconveniences that the air-fuel ratio, which changes every moment, cannot be accurately detected depending on the timing of sampling of the output from the LAF sensor 17, there is a time lag before exhaust gases emitted from the combustion chamber reach the LAF sensor 17, and the response time of the LAF sensor per se changes depending on operating conditions of the engine.

The block B11 has the function of a so-called observer, i.e. estimates a value of the air-fuel ratio separately for each cylinder from the air-fuel ratio detected at the confluent portion of the exhaust system (from a mixture of exhaust gases emitted from the cylinders) by the LAF sensor 17, and supplies the estimated value to a corresponding one of blocks B12 to B15 associated, respectively, with the four cylinders. In FIG. 2, the block B12 corresponds to a cylinder #1, the block B13 to a cylinder #2, the block B14 to a cylinder #3, and the block B15 to a cylinder #4. The block B12 to B15 calculate the cylinder-by-cylinder correction coefficient KOBSV#N(N=1 to 4) by the PID control such that the air-fuel ratio of each cylinder (the value of the air-fuel ratio estimated by the observer B11 for each cylinder) becomes equal to a value of the air-fuel ratio detected at the confluent portion, and supplies the calculated values to the blocks B5 to B8, respectively.

The block B18 calculates a PID correction coefficient KLAF by the PID control based on the difference between the actual air-fuel ratio and the desired air-fuel ratio, and supplies the calculated value to the block B4.

As described above, in the present embodiment, the fuel injection amount TOUT is calculated cylinder by cylinder by applying to the equation (1) the PID correction coefficient KLAF calculated by the PID control based on the output from the LAF sensor 17 and further the cylinder-by-cylinder correction coefficient KOBSV#N, which is set according to the air-fuel ratio value of each cylinder estimated based on the output from the LAF sensor 17. Variations in the air-fuel ratio between the cylinders can be eliminated by the use of the cylinder-by-cylinder correction coefficient KOBSV#N to thereby improve the purifying efficiency of the catalysts and hence achieve excellent exhaust emission characteristics of the engine in various operating conditions.

In the present embodiment, the functions of the blocks appearing in FIG. 2 are realized by arithmetic operations executed by the CPU of the ECU 5, and details of the operations will be described with reference to program routines illustrated in the drawings.

Figure 3:
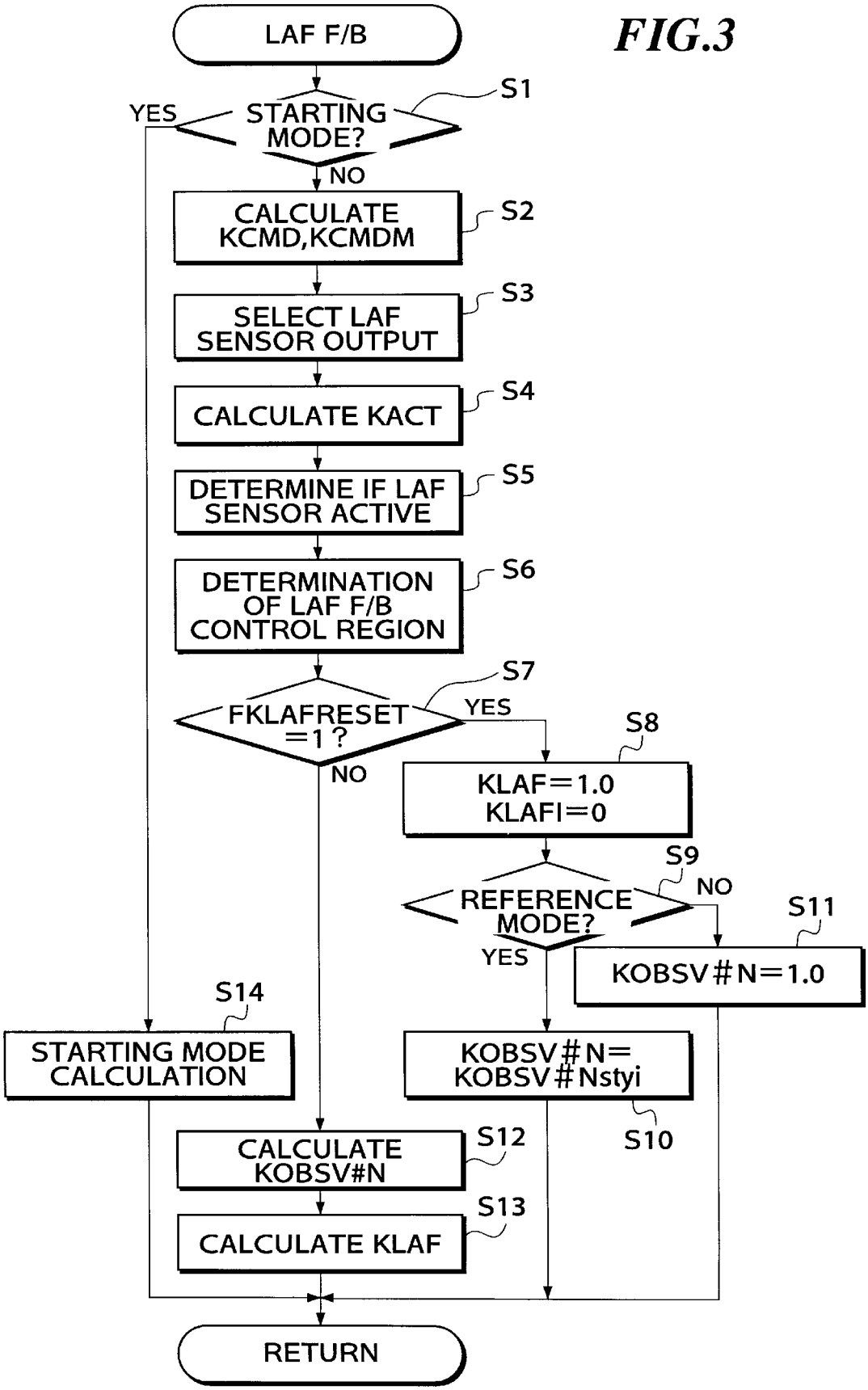
FIG. 3 is a flowchart showing a routine for calculating a PID correction coefficient KLAF and a cylinder-by-cylinder correction coefficient KOBSV#N in response to an output from a LAF sensor appearing in FIG. 1.

FIG. 3 shows a routine for calculating the PID correction coefficient KLAF and the cylinder-by-cylinder correction coefficient KOBSV#N based on the output from the LAF sensor 17. This routine is executed in synchronism with generation of each TDC signal pulse.

At a step S1, it is determined whether or not the engine is in a starting mode, i.e. whether or not the engine is being cranked. If the engine is in the starting mode, the program proceeds to a step S11 to execute a subroutine for the starting mode. If the engine is not in the starting mode, the desired air-fuel ratio coefficient (desired equivalent ratio) KCMD and the final desired air-fuel ratio coefficient KCMDM are calculated at a step S2, and the LAF sensor output-selecting process is executed at a step S3. Further, an actual equivalent ratio KACT is calculated at a step S4. The actual equivalent ratio KACT is obtained by converting the output from the LAF sensor 17 to an equivalent ratio valve.

Then, it is determined at a step S5 whether or not the LAF sensor 17 has been activated. This determination is carried out by comparing the difference between the output voltage from the LAF sensor 17 and a central voltage thereof with a predetermined value (e.g. 0.4 V), and determining that the LAF sensor 17 has been activated when the difference is smaller than the predetermined value.

Then, it is determined at a step S6 whether or not the engine 1 is in an operating region in which the air-fuel ratio feedback control responsive to the output from the LAF sensor 17 is to be carried out (hereinafter referred to as "the LAF feedback control region"). More specifically, it is determined that the engine 1 is in the LAF feedback control region e.g. when the LAF sensor 17 has been activated but at the same time neither fuel cut nor wide open throttle operation is being carried out. If it is determined at this step that the engine is not in the LAF feedback control region, a reset flag FKLAFRESET is set to "1", whereas if it is determined that the engine is in the LAF feedback control region, the reset flag FKLAFRESET is set to "0".

At the following step S7, it is determined whether or not the reset flag FKLAFRESET assumes "1". If FKLAFRESET=1 holds, the program proceeds to a step S8, wherein the PID correction coefficient KLAF is set to "1.0", and an integral term KLAFI used in the PID control is set to "0". Then, it is determined at a step S9 whether or not the engine is in a reference mode, referred to hereinafter, in which a learned value KOBSV#Nstyi of the cylinder-by-cylinder correction coefficient KOBSV#Ni is to be used. If the engine is not in the reference mode, the program proceeds to a step S11, wherein the cylinder-by-cylinder correction coefficient KOBSV#N is set to "1.0". On the other hand, if the engine is in the reference mode, the cylinder-by-cylinder correction coefficient KOBSV#N is set to the learned value KOBSV#Nstyi thereof at a step S10, followed by terminating the program.

The reference mode is defined as a mode, e.g. in which the LAF sensor is inactive and at the same time the engine is in a predetermined operating condition (i.e. both the engine rotational speed NE and the intake pipe absolute pressure PBA are within respective predetermined ranges). As described hereinafter, the learned value KOBSV#Nstyi (i=1 to 3) of the cylinder-by-cylinder correction coefficient KOBSV#Ni is calculated for each of three engine operating regions determined based on the intake pipe absolute pressure PBA, and therefore at the step S10, a region in which the engine is operating is determined, to use the learned value KOBSV#Nstyi (i=1 to 3) corresponding to the determined engine operating region.

On the other hand, if FKLAFRESET=0 holds at the step S7, the cylinder-by-cylinder correction coefficient KOBSV#N and the PID correction coefficient KLAF are calculated at steps 12 and S13, respectively, followed by terminating the program.

Figure 4:
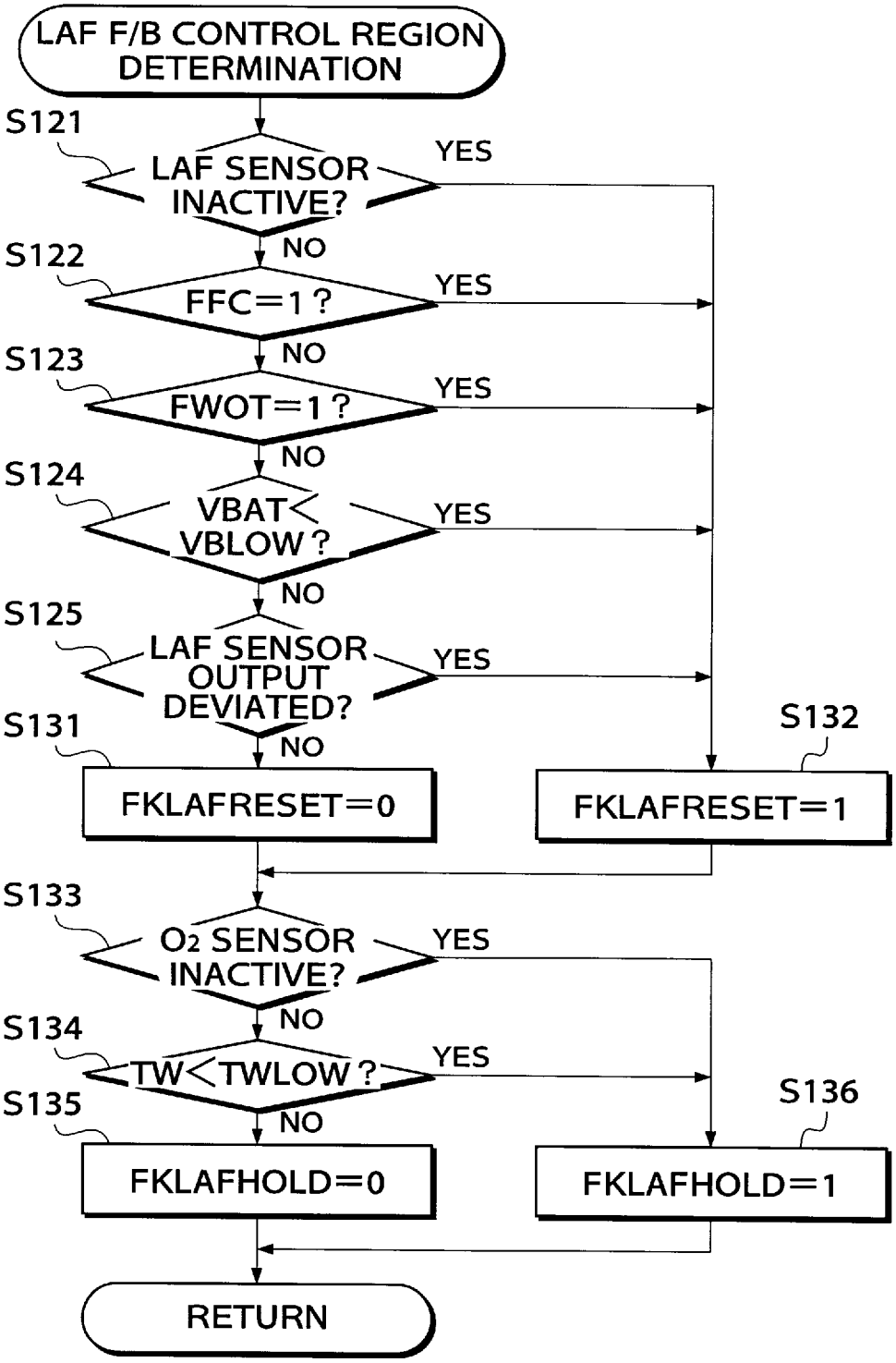
FIG. 4 is a flowchart showing a subroutine for determining whether the engine is operating in a LAF feedback control region, which is executed at a step S6 in FIG. 3.

FIG. 4 shows a LAF feedback control region-determining routine, which is executed at the step S6 in FIG. 3.

First, at a step S121, it is determined whether or not the LAF sensor 17 is inactive. If the LAF sensor 17 is inactive, it is determined at a step S122 whether or not a flag FFC, which, when set to "1", indicates that fuel cut is being carried out, assumes "1". If FFC=0 holds, it is determined at a step S123 whether or not a WOT flag FWOT, which, when set to "1", indicates that the engine is operating in a wide open throttle condition, assumes "1". If FWOT=0 holds, it is determined at a step S124 whether or not battery voltage VBAT detected by a battery voltage sensor, not shown, is lower than a predetermined lower limit value VBLOW. If VBAT≧VBLOW holds, it is determined at a step S125 whether or not there is a deviation of the LAF sensor output from a proper value corresponding to the stoichiometric air-fuel ratio (LAF sensor output deviation). If any of the answers to the questions of the steps S121 to S125 is affirmative (YES), the aforementioned reset flag FKLAFRESET, which, when set to "1", indicates that the feedback control based on the output from the LAF sensor should be stopped, is set to "1" at a step S132.

On the other hand, if all the answers to the questions of the steps S121 to S125 are negative (NO), it is judged that the feedback control based on the output from the LAF sensor can be carried out, and the reset flag FKLAFRESET is set to "0" at a step S131.

At the following step S133, it is determined whether or not the O2 sensor 18 is inactive. If the O2 sensor 18 is inactive, it is determined at a step 134 whether or not the engine coolant temperature TW is lower than a predetermined lower limit value TWLOW (e.g. 0° C.). If the O2 sensor 18 is inactive or if TW<TWLOW holds, a hold flag FKLAFHOLD, which, when set to "1", indicates that the PID correction coefficient KLAF should be held at the present value, is set to "1" at a step S136, followed by terminating the program. If the O2 sensor 18 is active and at the same time TW≧TWLOW holds, the hold flag FKLAFHOLD is set to "0" at a step S135, followed by terminating the program.

Next, description will be made of a subroutine for calculating the cylinder-by-cylinder correction coefficient KOBSV#N, which is executed at the step S9 in FIG. 3.

First, a manner of estimation of the cylinder-by-cylinder air-fuel ratio by the observer will be described, and then a manner of calculating the cylinder-by-cylinder correction coefficient KOBSV#N based on the estimated cylinder-by-cylinder air-fuel ratio will be described.

The air-fuel ratio detected at the confluent portion of the exhaust system is regarded as a weighted average value of air-fuel ratio values of the cylinders, which reflects time-dependent contributions of all the cylinders, whereby values of the air-fuel ratio detected at time points (k), (k+1), (k+2) are expressed by equations (2A), (2B), and (2C). In preparing these equations, the fuel amount (F) was used as an operation amount, and accordingly the fuel-air ratio F/A is used in these equations:

$$[F/A](k)=C_1[F/A\#1]+C_2[F/A\#3]\ C_3[F/A\#4]+C_4[F/A\#2] \tag{2A}$$

$$[F/A](k+1)=C_1[F/A\#3]+C_2[F/A\#4]\ C_3[F/A\#2]+C_4[F/A\#1] \tag{2B}$$

$$[F/A](k+2)=C_1[F/A\#4]+C_2[F/A\#2]\ C_3[F/A\#1]+C_4[F/A\#3] \tag{2C}$$

Figure 5:
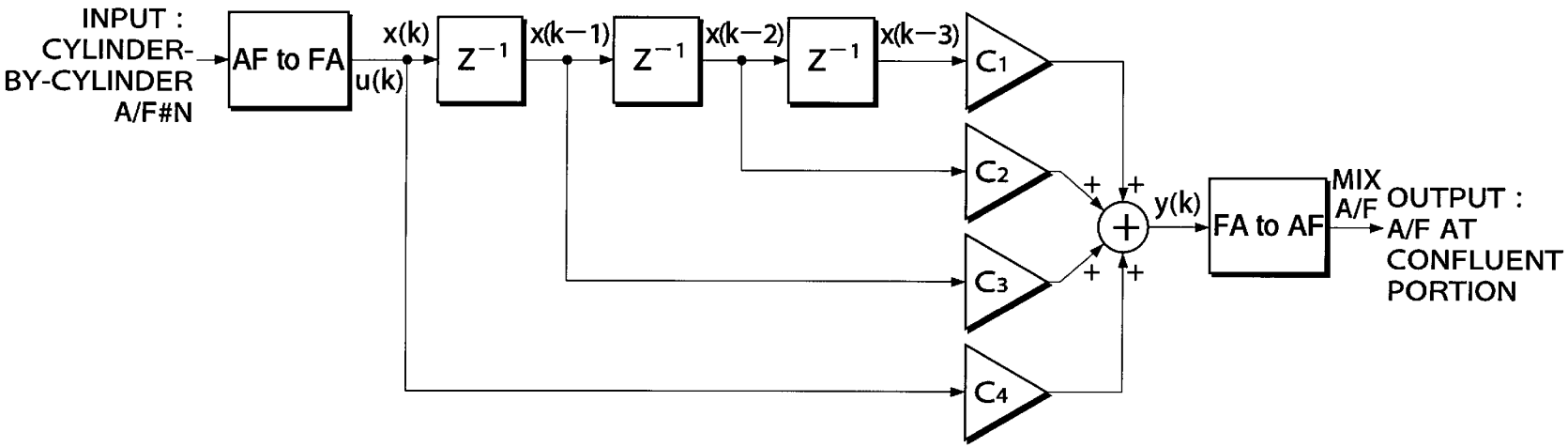
FIG. 5 is a block diagram showing a model representative of a behavior of the exhaust system of the engine.

More specifically, the fuel-air ratio detected at the confluent portion of the exhaust system is expressed as the sum of values of the cylinder-by-cylinder fuel-air ratio multiplied by respective weights C varying in the order of combustion (e.g. 40% for a cylinder corresponding to the immediately preceding combustion, 30% for one corresponding to the second preceding combustion, and so on). This model can be expressed in block diagrams as shown in FIG. 5, and the state equation therefor is expressed by the following equation (3):

$$\begin{bmatrix} x(k-2) \\ x(k-1) \\ x(k) \end{bmatrix} = \begin{bmatrix} 0\ 1\ 0 \\ 0\ 0\ 1 \\ 0\ 0\ 0 \end{bmatrix} \begin{bmatrix} x(k-3) \\ x(k-2) \\ x(k-1) \end{bmatrix} + \begin{bmatrix} 0 \\ 0 \\ 1 \end{bmatrix} u(k) \tag{3}$$

Further, if the fuel-air ratio detected at the confluent portion is designated by y(k), the output equation can be expressed by the following equation (4):

$$y(k) = [c_1 \quad c_2 \quad c_3] \begin{bmatrix} x(k-3) \\ x(k-2) \\ x(k-1) \end{bmatrix} + c_4 u(k) \tag{4}$$

where, $c_1$: 0.05, $c_2$: 0.15, $c_3$: 0.30, $c_4$: 0.05.

In the equation (4), u(k) cannot be observed, and hence an observer designed based on this state equation cannot enable observation of x(k). Therefore, on the assumption that a value of the air-fuel ratio detected four TDC signal pulses earlier (i.e. the immediately preceding value for the same cylinder) represents a value obtained under a steady operating condition of the engine without any drastic change in the air-fuel ratio, it is regarded that x(k+1)=x(k−3), whereby the equation (4) can be changed into the following equation (5):

$$\begin{bmatrix} x(k-2) \\ x(k-1) \\ x(k) \\ x(k+1) \end{bmatrix} = \begin{bmatrix} 0\ 1\ 0\ 0 \\ 0\ 0\ 1\ 0 \\ 0\ 0\ 0\ 1 \\ 1\ 0\ 0\ 0 \end{bmatrix} \begin{bmatrix} x(k-3) \\ x(k-2) \\ x(k-1) \\ x(k) \end{bmatrix}$$

$$y(k) = [c_1 \quad c_2 \quad c_3 \quad c_4] \begin{bmatrix} x(k-3) \\ x(k-2) \\ x(k-1) \\ x(k) \end{bmatrix} \tag{5}$$

It was empirically ascertained that the above model accurately represents the exhaust system of a four-cylinder engine. Therefore, a problem arising from estimating the cylinder-by-cylinder air-fuel ratio from the air-fuel ratio A/F detected at the confluent portion of the exhaust system is the same as a problem with an ordinary Kalman filter used in observing x(k) by the following state equation and output equation (6). If weight matrices Q, R are expressed by the following equation (7), the Riccati's equation can be solved to obtain a gain matrix K represented by the following equation (8):

$$X(k+1)=AX(k)+Bu(k)$$

$$y(k)=CX(k)+Du(k) \tag{6}$$

where $$A = \begin{bmatrix} 0\ 1\ 0\ 0 \\ 0\ 0\ 1\ 0 \\ 0\ 0\ 0\ 1 \\ 1\ 0\ 0\ 0 \end{bmatrix} C = [c_1 \quad c_2 \quad c_3 \quad c_4]\ B = D = [0]$$

-continued $$X(k)=\begin{bmatrix} x(k-3) \\ x(k-2) \\ x(k-1) \\ x(k) \end{bmatrix}$$

$$Q=\begin{bmatrix} 1\,0\,0\,0 \\ 0\,1\,0\,0 \\ 0\,0\,1\,0 \\ 0\,0\,0\,1 \end{bmatrix} R=[1] \tag{7}$$

$$K=\begin{bmatrix} -0.3093 \\ 1.1916 \\ 0.3093 \\ 0.0803 \end{bmatrix} \tag{8}$$

Figure 6:
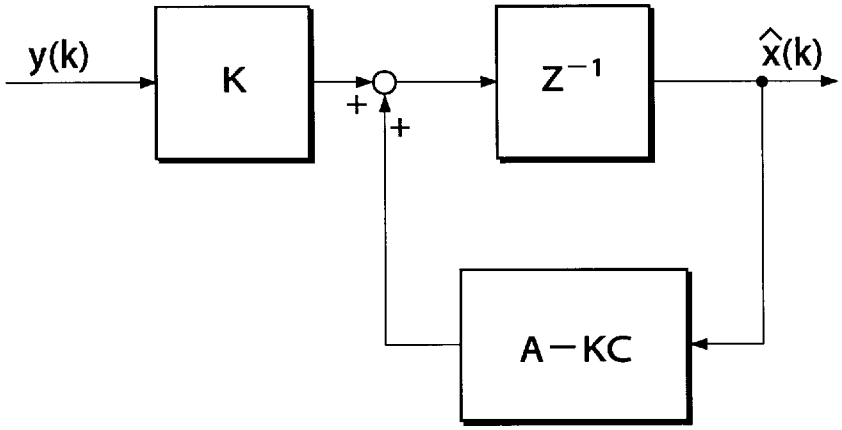
FIG. 6 is a block diagram showing the construction of an observer according to the embodiment.

In the model of the present embodiment, there is no inputting of u(k)which is input to an observer of a general type, so that the observer of the present embodiment is constructed such that y(k) alone is input thereto as shown in FIG. 6, which is expressed by the following equation (9):

$$\begin{aligned} \hat{X}(k+1) &= [A-KC]\hat{X}(k)+Ky(k) \\ &= A\hat{X}(k)+K(y(k)-C\hat{X}(k)) \\ \hat{x}(k) &= \begin{bmatrix} \hat{x}(k-3) \\ \hat{x}(k-2) \\ \hat{x}(k-1) \\ \hat{x}(k) \end{bmatrix} \end{aligned} \tag{9}$$

Therefore, from the fuel-air ratio y(k) at the confluent portion and the estimated value $\hat{X}(k)$ of the cylinder-by-cylinder fuel-air ratio obtained in the past, the estimated value $\hat{X}(k+1)$ of the same in the present loop can be calculated.

When the estimated value $\hat{X}(k+1)$ of the cylinder-by-cylinder fuel-air ratio is calculated by the use of the above equation (9), the actual equivalent ratio KACT(k) is used as the fuel-air ratio y(k) at the confluent portion. This actual equivalent ratio KACT(k) contains the response delay of the LAF sensor 17, whereas the $C\hat{X}(k)$ (i.e. the sum of the four cylinder-by-cylinder fuel-air ratio values multiplied by respective weights) does not contain the same. Therefore, the equation (9) cannot enable accurate estimation of the cylinder-by-cylinder fuel-air ratio, due to the response delay of the LAF sensor 17. Particularly, when the engine rotational speed is high, where time intervals of generation of TDC signal pulses are shorter, the response delay of the LAF sensor has a larger adverse effect on the estimation of the cylinder-by-cylinder fuel-air ratio.

Therefore, in the present embodiment, an estimated value $\hat{y}(k)$ of the fuel-air ratio at the confluent portion of the engine is calculated by the use of the following equation (10), and then the thus calculated value $\hat{y}(k)$ is applied to the following equation (11) to thereby obtain the estimated value $\hat{X}(k+1)$ of the cylinder-by-cylinder fuel-air ratio:

$$\hat{y}(k)=DL\hat{y}(k-1)+(1-DL)C\hat{X}(k) \tag{10}$$

$$\hat{X}(k+1)=A\hat{X}(k)+K(y(k)-\hat{y}(k)) \tag{11}$$

Figure 7:
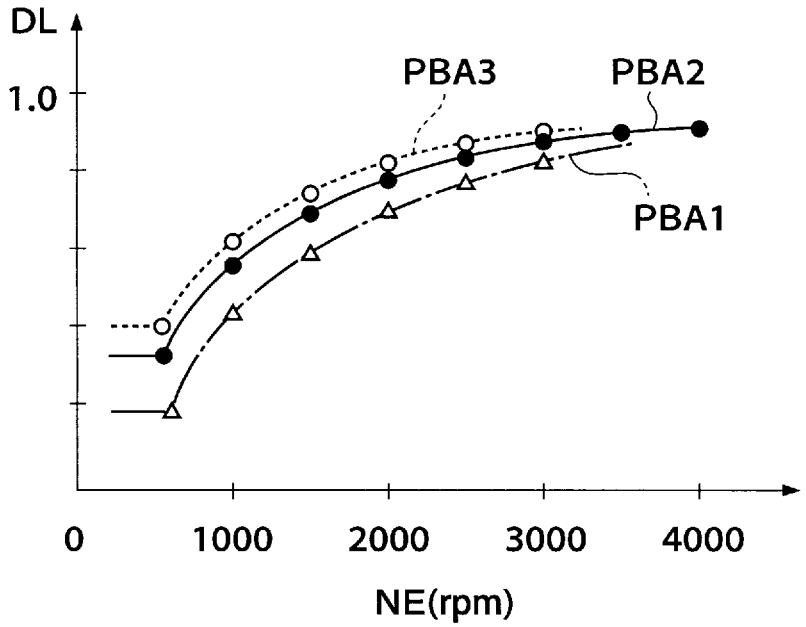
FIG. 7 shows a table for determining a time constant (DL) of response delay of the LAF sensor.

In the above equation (10), DL represents a parameter corresponding to a time constant of the response delay of the LAF sensor 17. In the present embodiment, the DL value is calculated by the use of a DL table shown in FIG. 7. The DL table is set such that the DL value assumes a value between "0" and "1.0" according to the engine rotational speed NE and the intake pipe absolute pressure PBA. In the figure, PBA1 to PBA3 represent e.g. 660 mmHg, 460 mmHg, 260 mmHg, respectively, and the DL value is determined, if required, additionally by interpolation according to the detected engine rotational speed NE and intake pipe absolute pressure PBA. It has been empirically ascertained that the best compensation for the response delay of the lAF sensor 17 can be obtained if the DL value is set to a value corresponding to a time period which is approximately 20% longer than the actual response delay time period.

In the equations (10) and (11), the estimated value $\hat{X}(k)$ has an initial vector thereof set such that component elements thereof, i.e. $\hat{X}(k-3)$, $\hat{X}(k-2)$, $\hat{X}(k-1)$, $\hat{X}(k)$ are all equal to "1.0", and in the equation (10), an initial value of $\hat{y}(k-1)$ is set to "1.0".

By the use of the equation (11) in which, as described above, the $C\hat{X}(k)$ of the equation (9) is replaced by the estimated value $\hat{y}(k)$ of the fuel-air ratio at the confluent portion which contains the response delay of the LAF sensor, it is possible to properly compensate for the response delay of the LAF sensor and hence estimate the value of the cylinder-by-cylinder air-fuel ratio with accuracy. It should be noted that in the following description each of estimated equivalent ratios KACT#1(k) to KACT#4(k) for the respective cylinders corresponds to $\hat{X}(k)$.

Figure 8:
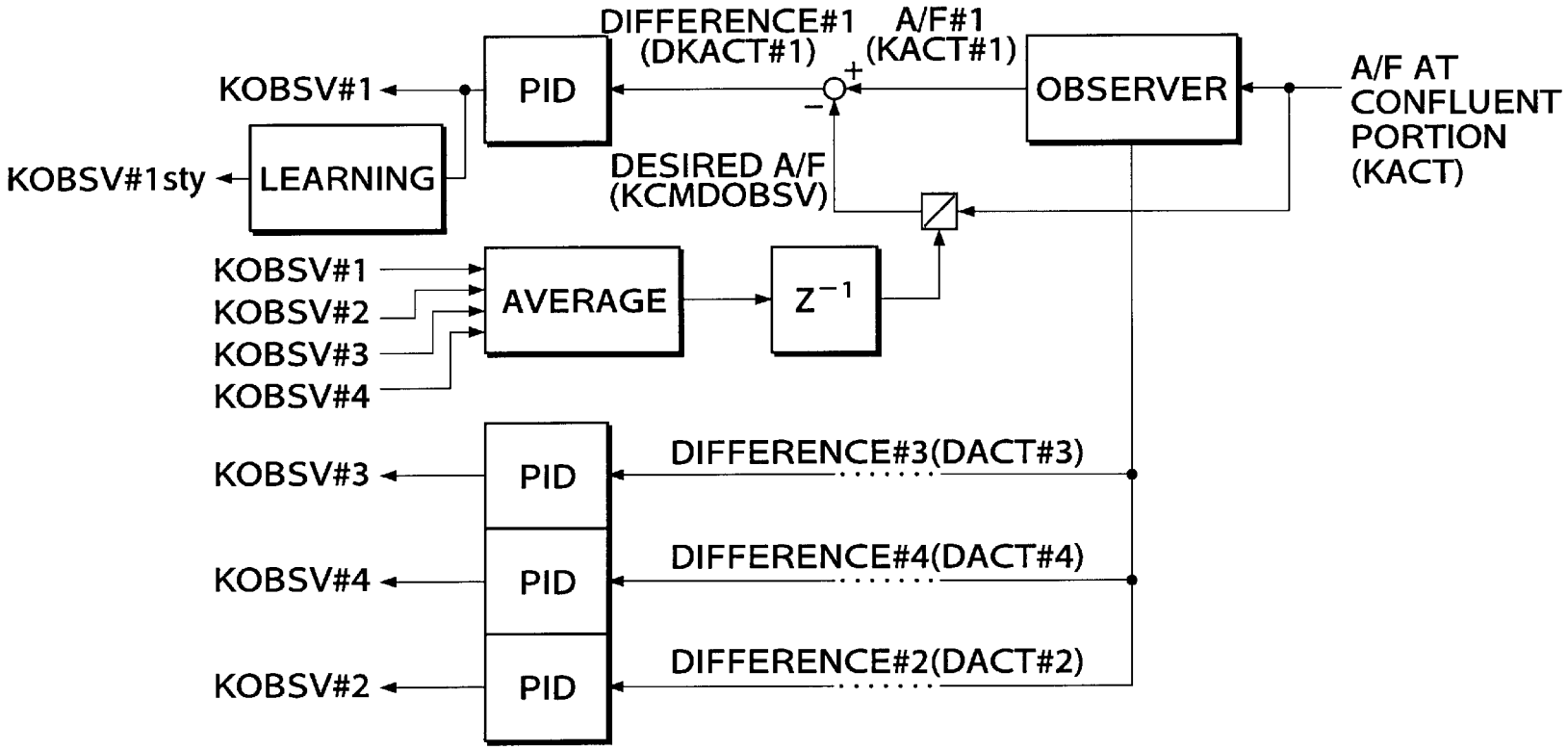
FIG. 8 is a block diagram useful in explaining how the air-fuel ratio feedback control is carried out cylinder by cylinder.

Next, a manner of calculating the cylinder-by-cylinder correction coefficient KOBSV#N based on the thus estimated cylinder-by-cylinder air-fuel ratio will be described with reference to FIG. 8.

First, as shown in equation (12), a desired value KCMDOBSV(k) as an equivalent ratio corresponding to the desired air-fuel ratio A/F is calculated by dividing the actual equivalent ratio KACT at the confluent portion by the immediately preceding value of an average value of the cylinder-by-cylinder correction coefficient KOBSV#N for all the cylinders. The cylinder-by-cylinder correction coefficient KOBSV#1 for the #1 cylinder is calculated by the PID control such that the difference DKACT#1(k) (=KACT#1(k)−KCMDOBSV(k)) between the desired value KCMDOBSV(k) and the cylinder-by-cylinder equivalent ratio KACT#1 estimated for the #1 cylinder becomes equal to zero.

$$KCMDOBSV(k)=KACT(k)/\left(\sum_{N=1}^{4} KOBSV\#N(k-1)/4\right) \tag{12}$$

More specifically, a proportional term KOBSVP#1, an integral term KOBSVI#1, and a differential term KOBSVD#1 are calculated by the use of the following equations (13A to 13C). Then, the cylinder-by-cylinder correction coefficient KOBSV#1 for the #1 cylinder is calculated by the use of the following equation (14):

$$KOBSVP\#1(k)=KPOBSV\times DKACT\#1(k) \tag{13A}$$

$$KOBSVI\#1(k)=KIOBSV\times DKACT\#1(k)+KOBSVI\#1(k-1) \tag{13B}$$

$$KOBSVD\#1(k)=KDOBSV\times(DKACT\#1(k)-DKACT\#1(k-1) \tag{13C}$$

$$KOBSV\#1(k)=KOBSVP\#1(k)+KOBSVI\#1(k)+KOBSVD\#1(k)+1.0 \tag{14}$$

where KPOBSV, KIOBSV and KDOBSV represent a basic proportional term, a basic integral term, and a basic differential term, respectively.

Similar calculations are carried out for the other cylinders #2 to #4 to obtain cylinder-by-cylinder correction coefficient values KOBSV#2 to #4.

By this control operation, the air-fuel ratio of the mixture supplied to each cylinder is converged to the air-fuel ratio detected at the confluent portion of the exhaust system. Since the air-fuel ratio at the confluent portion is converged to the desired air-fuel ratio by the use of the PID correction coefficient KLAF, the air-fuel ratio values of mixtures supplied to all the cylinders can be eventually converged to the desired air-fuel ratio.

Further, a learned value KOBSV#Nsty of the cylinder-by-cylinder correction coefficient KOBSV#N is calculated for each operating region by the use of the following equation (15) and stored in the RAM backed up by a battery.

$$KOBSV\#Nstyi=Csty\times KOBSV\#N+(1-Csty)\times KOBSV\#Nstyi \quad (15)$$

where i represents a parameter indicative of an operating region (i=1 to 3), Csty a weighting coefficient, and KOBSV#Nstyi on the right side of the equation the immediately preceding learned value.

Figure 9:
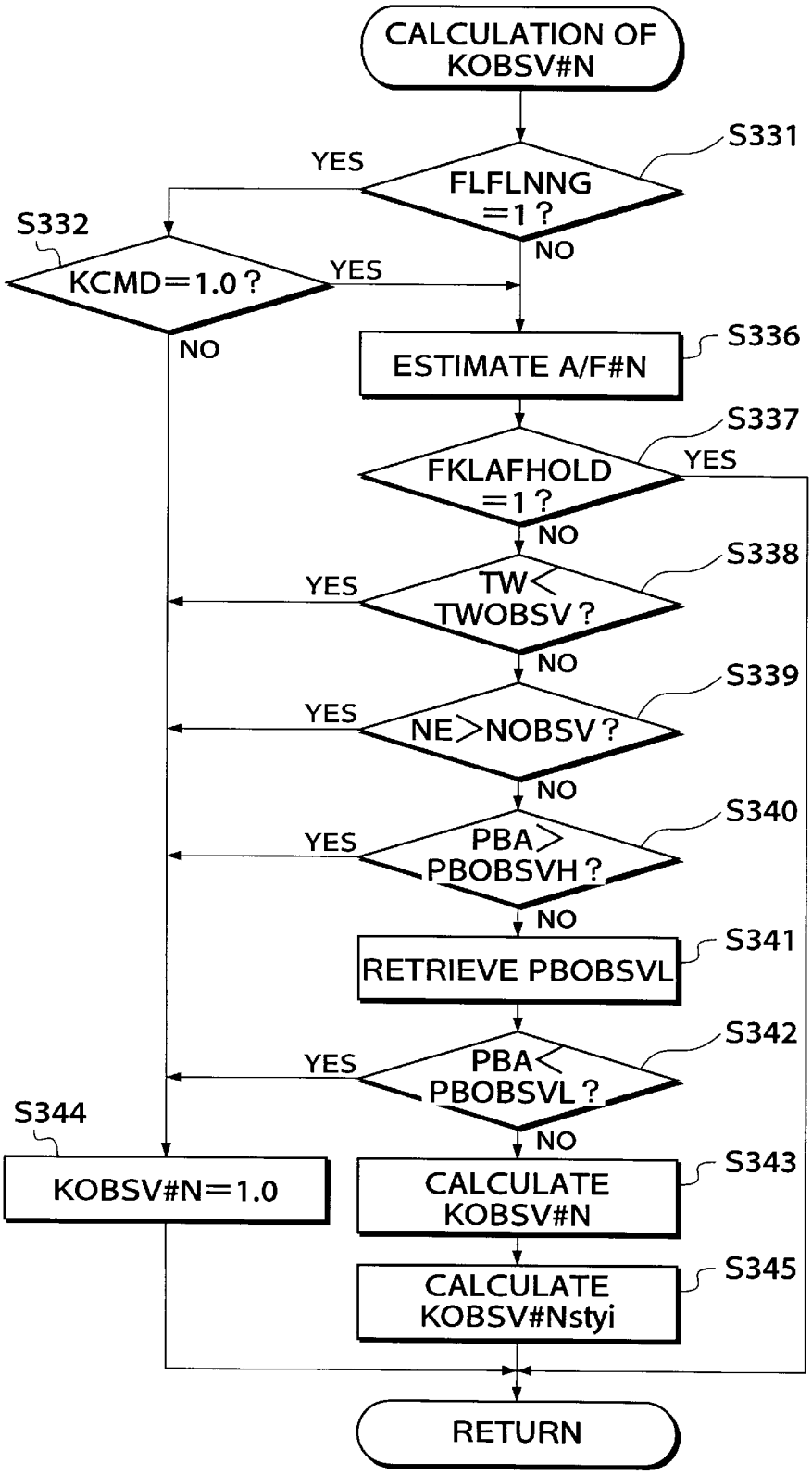
FIG. 9 is a flowchart showing a subroutine for calculating the cylinder-by-cylinder correction coefficient KOBSV#N, which is executed at a step S12 in FIG. 3.

FIG. 9 shows a subroutine for calculating the cylinder-by-cylinder correction coefficient KOBSV#N, which is executed at the step S12 in FIG. 3.

First, it is determined at a step S331 whether or not lean output deterioration of the LAF sensor 17 has been detected. If the lean output deterioration has not been detected, the program jumps to a step S336, whereas if the lean output deterioration has been detected, it is determined at a step S332 whether or not the desired air-fuel ratio KCMD is equal to 1.0, i.e. whether or not the desired air-fuel ratio is equal to the stoichiometric air-fuel ratio. The lean output deterioration of the LAF sensor means that the output from the LAF sensor exhibited when the air-fuel ratio of the mixture is actually controlled to a value leaner than the stoichiometric air-fuel ratio deviates from a proper value to a degree beyond a predetermined limit. If KCMD=1.0 holds at the step S332, the program proceeds to the step S336, whereas if KCMD≠1.0 holds, the cylinder-by-cylinder correction coefficient KOBSV#N for all the cylinders is set to 1.0 at a step S344, to inhibit execution of the cylinder-by-cylinder air-fuel ratio feedback control, followed by terminating the program.

At the step S336, the air-fuel ratio is estimated cylinder by cylinder by the observer described above, and then it is determined at a step S337 whether or not a hold flag FKLAFHOLD, which, when set to "1", indicates that the PID correction coefficient should be held at the present value, assumes "1". If FKLAFHOLD=1 holds at the step S337, the present program is immediately terminated.

Figure 11:
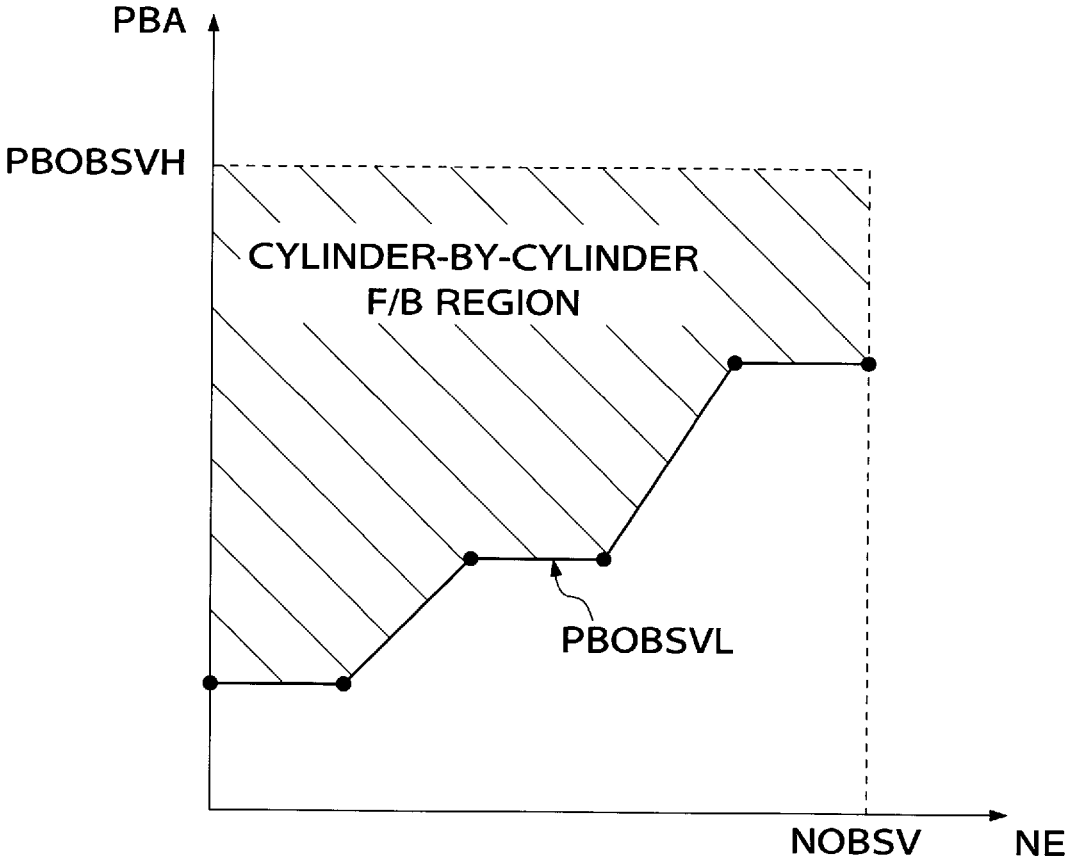
FIG. 11 is a diagram which is useful in explaining a cylinder-by-cylinder feedback control region.

If FKLAFHOLD=0 holds at the step S337, it is determined at a step S338 whether or not the engine coolant temperature TW is lower than a predetermined value TWOBSV. If TW≧TWOBSV holds at the step S338, it is determined at a step S339 whether or not the engine rotational speed NE is higher than a predetermined value NOBSV (e.g. 3500 rpm). If NE≦NOBSV holds at the step S339, it is determined at a step S340 whether or not the intake pipe absolute pressure PBA is higher than a predetermined upper limit value PBOBSVH (e.g. 650 mmHg). If PBA≦PBOBSVH holds at the step S340, a PBOBSVL table shown in FIG. 11 is retrieved according to the engine rotational speed NE to determine a lower limit value PBOBSVL of the intake pipe absolute pressure at a step S341, and it is determined at a step S342 whether or not the intake pipe absolute pressure PBA is lower than the determined lower limit value PBOBSVL.

If any of the answers to the questions of the steps S338 to S340, and S342 is affirmative (YES), the program proceeds to the step S344. In this case, the cylinder-by-cylinder air-fuel ratio feedback control is not carried out. On the other hand, if all the answers to the questions of the steps S338 to S340 and S342 are negative (NO), it is judged that the engine is in an operating region corresponding to a hatched area in FIG. 11, which means that the cylinder-by-cylinder air-fuel ratio feedback control can be carried out, so that the cylinder-by-cylinder correction coefficient KOBSV#N is calculated in the above described manner at a step S343, and then the learned value KOBSV#Nstyi of the cylinder-by-cylinder correction coefficient is calculated at a step S345, followed by terminating the program.

Figure 10:
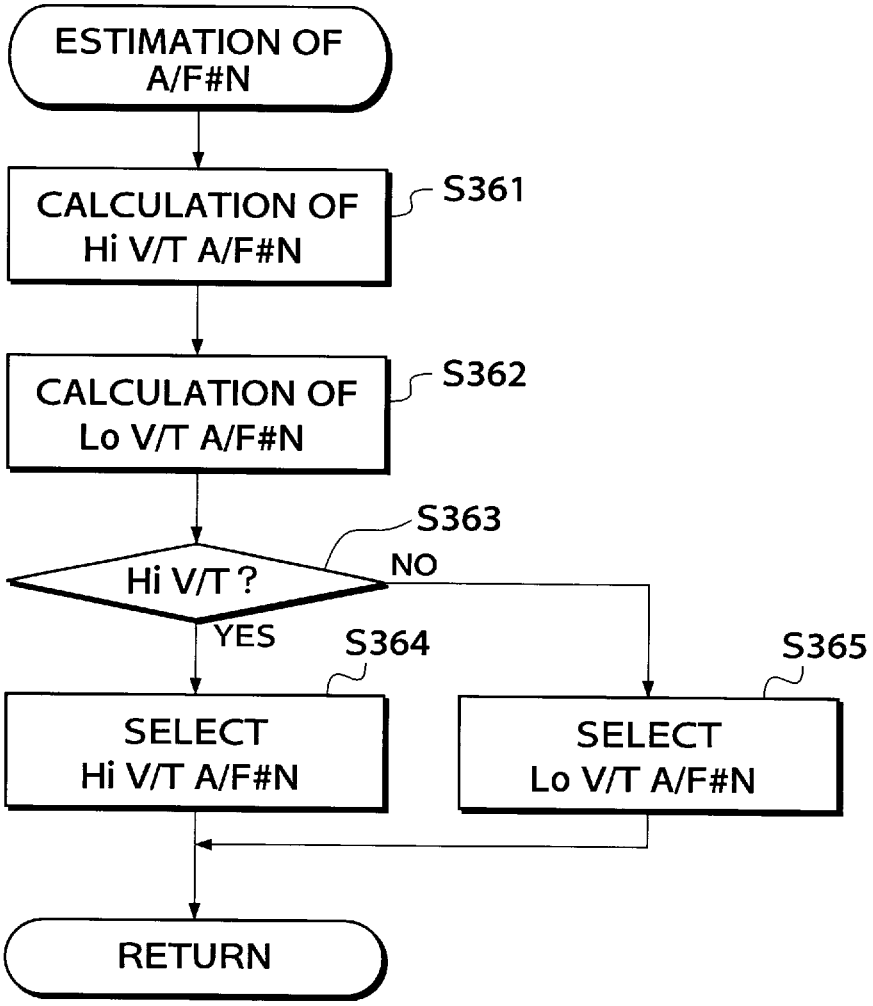
FIG. 10 is a flowchart showing a subroutine for estimating a cylinder-by-cylinder air-fuel ratio, which is executed at a step S336 in FIG. 9.

FIG. 10 shows a subroutine for estimating the cylinder-by-cylinder air-fuel ratio, which is executed at the step S336 in FIG. 9.

First, at a step S361, an arithmetic operation by the use of the observer (i.e. estimation of the cylinder-by-cylinder air-fuel ratio value) for the high-speed valve timing is carried out, and at the following step S362, an arithmetic calculation by the use of the observer for the low-speed valve timing is carried out. Then, it is determined at a step S363 whether or not the present valve timing is set to the high-speed valve timing. If the present valve timing is set to the high -speed valve timing, a result of the observer arithmetic operation for the high-speed valve timing is selected at a step S364, whereas if the present valve timing is set to the low-speed valve timing, a result of the observer arithmetic operation for the low-speed valve timing is selected at a step S365.

The reason why the observer arithmetic operations for the high-speed valve timing and the low-speed valve timing are thus carried out before determining the present valve timing is that the estimation of the cylinder-by-cylinder air-fuel ratio requires several times of arithmetic operations before the estimation results are converged. By the above manner of estimation, it is possible to enhance the accuracy of estimation of the cylinder-by-cylinder air-fuel ratio immediately after changeover of the valve timing.

Figure 12:
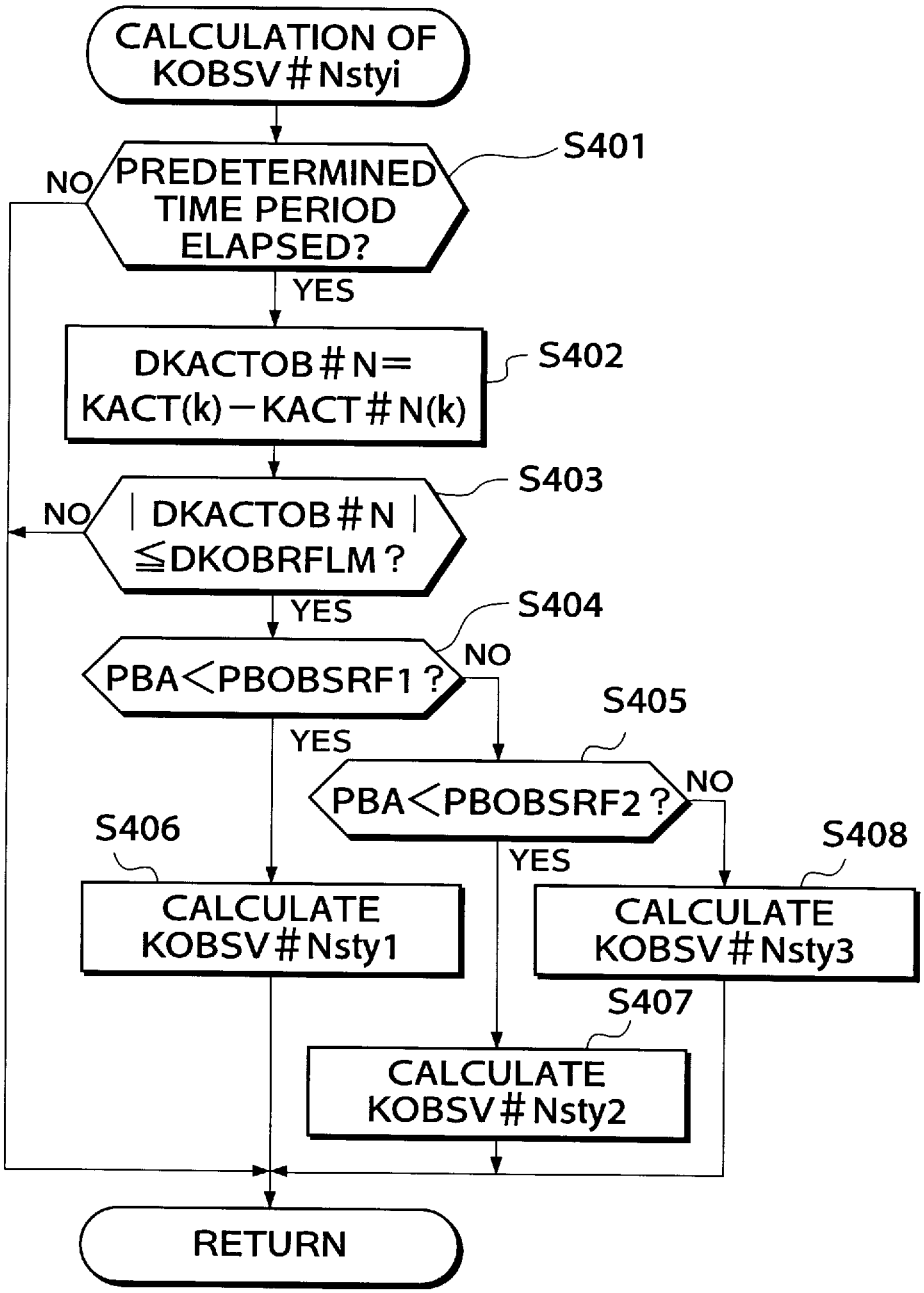
FIG. 12 is a flowchart showing a subroutine for calculating a learned value KOBSV#Nstyi of the cylinder-by-cylinder correction coefficient KOBSV#N, which is executed at a step S10 in FIG. 3.

FIG. 12 shows a subroutine for calculating the learned value KOBSV#Nstyi of the cylinder-by-cylinder correction coefficient, which is executed at the step S345 in FIG. 9.

First, at a step S401 in FIG. 12, it is determined whether or not a predetermined time period has elapsed from a time point of the start of the present cylinder-by cylinder feedback control (i.e. a time point at which the engine operating region has shifted from the region in which the conditions for executing the cylinder-by-cylinder feedback control are not fulfilled to the region in which the conditions are fulfilled). If the predetermined time period has not elapsed, the program is immediately terminated, whereas if the predetermined time period has elapsed, the program proceeds to a step S402, wherein an equivalent ratio difference DKACTOB#N as a difference between the actual equivalent ratio KACT(k) and the estimated cylinder-by-cylinder equivalent ratio KACT#N(k) is calculated by the use of the following equation (16):

$$DKACTOB\#N=KACT(k)-KACT\#N(k) \quad (16)$$

Further, it is determined at a step S403 whether or not the absolute value |DKACTOB#N| of the equivalent ratio difference is equal to or smaller than a predetermined value DKOBRFLM. If |DKACTOB#N|>DKOBRFLM holds, the program is terminated without calculating the learned value KOBSV#Nstyi of the cylinder-by-cylinder correction coefficient.

If |DKACTOB#N|≦DKOBRFLM holds, the learned value KOBSV#Nstyi of the cylinder-by-cylinder correction coefficient is calculated for each operating region, as described below, followed by terminating the program.

That is, if the intake pipe absolute pressure PBA is lower than a first predetermined value PBOBSRF1 at a step S404, a learned value KOBSV#Nsty1 is calculated by the use of the equation (15) and stored in the backup RAM at a step S406. If the intake pipe absolute pressure PBA is equal to or higher than the first predetermined pressure PBOBSRF1 and at the same time lower than a second predetermined pressure PBOBSRF2, which is higher than the first predetermined pressure PBOBSRF1, at the step S404 and a step S405, a learned value KOBSV#Nsty2 is calculated by the use of the equation (15) and stored in the backup RAM at a step S407. Further, if the intake pipe absolute pressure PBA is equal to or higher than the second predetermined pressure PBOBSRF2 at the step S405, a learned value KOBSV#Nsty3 is calculated and stored in the backup RAM at a step S408.

In the present embodiment, as described above, when the absolute value of the difference DKACTOB#N between the actual equivalent ratio KACT and the estimated cylinder-by-cylinder equivalent ratio KACT#N is larger than the predetermined value DKOBRFLM, the learned value KOBSV#Nstyi is not calculated (updated). Therefore, the learned value KOBSV#Nstyi is not updated e.g. immediately after the start of the cylinder-by-cylinder air-fuel ratio feedback control or during execution of perturbation of the air-fuel ratio, which makes it possible to prevent the learned value KOBSV#Nstyi from deviating from a proper value. As a result, the actual air-fuel ratio is prevented from deviating largely from a desired value when the learned value KOBSV#Nstyi is used, and hence excellent air-fuel ratio controllability can be obtained.

What is claimed is:

1. An air-fuel ratio control system for an internal combustion engine having a plurality of cylinders, and an exhaust system connected to said plurality of cylinders, comprising:

air-fuel ratio-detecting means arranged in said exhaust system;

cylinder-by-cylinder air-fuel ratio-estimating means for estimating an air-fuel ratio of a mixture supplied to each of said cylinders, based on an output from said air-fuel ratio-detecting means and a model representative of a behavior of said exhaust system;

cylinder-by-cylinder air-fuel ratio control amount-calculating means for calculating a cylinder-by-cylinder air-fuel ratio control amount for use in controlling said air-fuel ratio of said mixture supplied to said each of said cylinders in a feedback manner responsive to the estimated air-fuel ratio of said mixture such that the estimated air-fuel ratio of said mixture supplied to said each of said cylinders is converged to a desired air-fuel ratio;

learned value-calculating means for calculating a learned value of said cylinder-by-cylinder air-fuel ratio control amount; and inhibiting means for comparing a difference between said air-fuel ratio detected by said air-fuel ratio detecting means and the estimated air-fuel ratio of said mixture supplied to said each of said cylinders with a predetermined value, and when the former is larger than the latter, inhibiting said learned value-calculating means from calculating said learned value of said cylinder-by-cylinder air-fuel ratio control amount.

2. An air-fuel ratio control system according to claim 1, wherein said cylinder-by-cylinder air-fuel ratio-estimating means includes observer means for observing an internal operative state of said exhaust system by means of said model representative of said behavior of said exhaust system, and for estimating said air-fuel ratio of said mixture supplied to said each of said cylinders, based on said output from said air-fuel ratio-detecting means.

3. An air-fuel ratio control system according to claim 1, wherein said exhaust system has at least one confluent portion at which said air-fuel ratio-detecting means is arranged.

4. An air-fuel ratio control system according to claim 2, wherein said cylinder-by-cylinder air-fuel ratio-estimating means estimates said air-fuel ratio of said mixture supplied to said each of said cylinders, by the use of a time constant of response delay of said air-fuel ratio-detecting means.

5. An air-fuel ratio control system according to claim 2, wherein said inhibiting means inhibits said learned value-calculating means from calculating said learned value of said cylinder-by-cylinder air-fuel ratio control amount without comparing the difference between said air-fuel ratio detected by said air-fuel ratio detecting means and the estimated air-fuel ratio of said mixture supplied to said each of said cylinder with said predetermined value, before a predetermined time period elapses after start of the control of said air-fuel ratio of said mixture supplied to said each of said cylinders in said feedback manner responsive to the estimated air-fuel ratio of said mixture.

6. An air-fuel ratio control system according to claim 4, wherein said engine has an intake system, said learned value-calculating means calculating said leaned value of said cylinder-by-cylinder air-fuel ratio control amount for each of a plurality of predetermined ranges of pressure within said intake system.

7. An air-fuel ratio control system according to claim 6, wherein when said air-fuel ratio-detecting means is inoperative and at the same time said engine is in a predetermined operating region determined by rotational speed of said engine and said pressure within said intake system, said learned value of said cylinder-by-cylinder air-fuel ratio control amount calculated for one of said plurality of predetermined ranges of pressure within said intake system is employed when said pressure within said intake system assumes a value within said one of said plurality of predetermined ranges.

* * * * *